US006481921B1

(12) United States Patent
Fenimore et al.

(10) Patent No.: US 6,481,921 B1
(45) Date of Patent: Nov. 19, 2002

(54) VEHICLE BARRIER/ADVERTISEMENT SYSTEM

(76) Inventors: Scott Fenimore, 330 8th Ave. North, Unit 7, Tierra Verde, FL (US) 33715; Richard Militana, 9500 Nations Rd., Webster, FL (US) 33597

( * ) Notice: Subject to any disclaimer, the term of this patent is extended or adjusted under 35 U.S.C. 154(b) by 0 days.

(21) Appl. No.: 09/918,212

(22) Filed: Jul. 30, 2001

(51) Int. Cl.[7] ..... E01C 11/22
(52) U.S. Cl. ..... 404/7
(58) Field of Search ..... 404/6, 7, 9; 40/612; D10/113; D20/10, 15

(56) References Cited

U.S. PATENT DOCUMENTS 198,651 A * 12/1877 McMullen ..... 40/612
674,672 A * 5/1901 Culver ..... 404/38
1,065,231 A * 6/1913 Finger ..... 362/812
1,412,769 A * 4/1922 Barnes ..... 256/63
3,636,829 A * 1/1972 Palmer ..... 404/7
4,142,814 A * 3/1979 Sanchez ..... 256/1
4,762,438 A * 8/1988 Dewing ..... 404/6
4,813,811 A * 3/1989 Adams ..... 404/13
5,199,375 A * 4/1993 Johson ..... 116/209
5,333,745 A * 8/1994 Lehmann ..... 211/184
D351,422 S * 10/1994 Morris ..... D20/10
5,772,357 A * 6/1998 Evans ..... 256/13.1
5,882,140 A * 3/1999 Yodock et al. ..... 256/13.1
D420,928 S 2/2000 Spiller

* cited by examiner

*Primary Examiner*—Gary S. Hartmann

(57) ABSTRACT

A vehicle barrier/advertisement system comprises a thin barrier cover. The barrier cover has a vertical front face and a vertical rear face and a horizontal upper face and a pair of angled intermediate faces there between. The barrier cover also has a pair of end faces. The cover has a generally horizontal lower opening. The cover is sized and shaped to be securely positioned over a vehicle parking barrier. An advertisement sheet has an interior surface. The interior surface is positioned with respect to an angled intermediate face of the cover. The sheet also has an exterior surface with advertising indicia there on. A plurality of straps assist in holding the cover to the barrier.

2 Claims, 4 Drawing Sheets

FIG 2
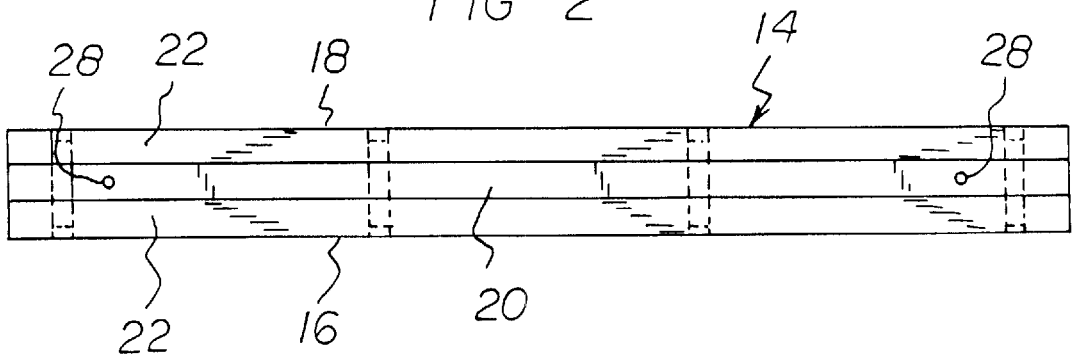
FIG 3
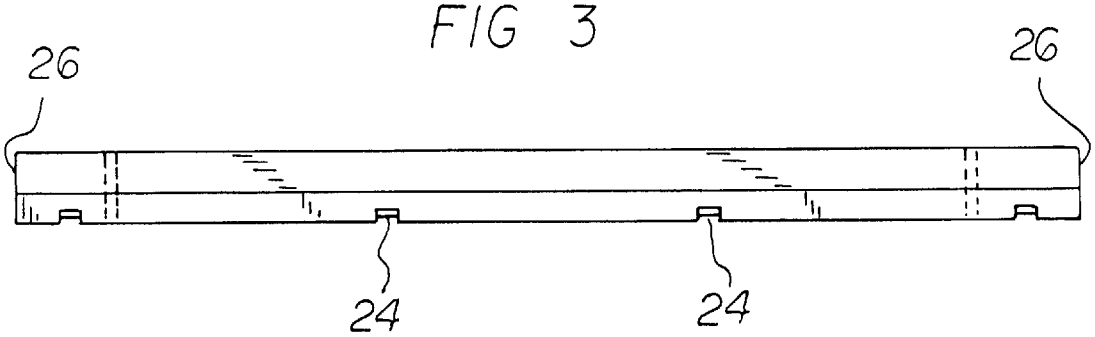
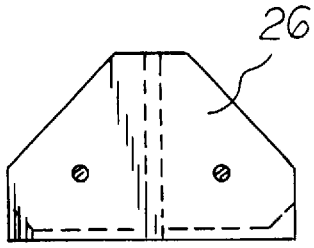
FIG 4

FIG 5
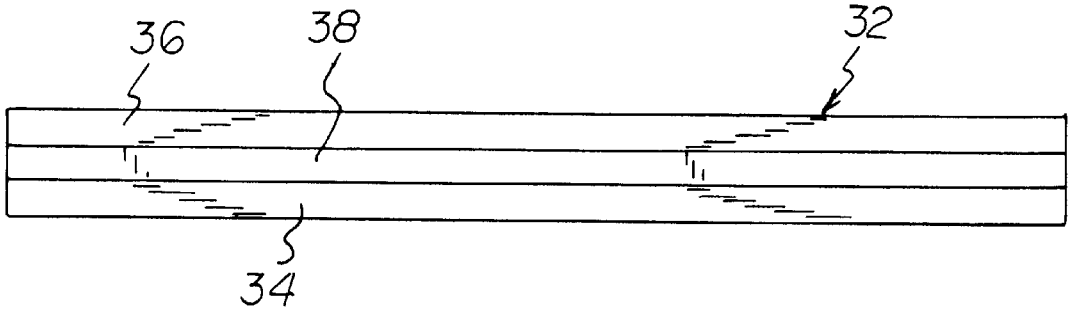
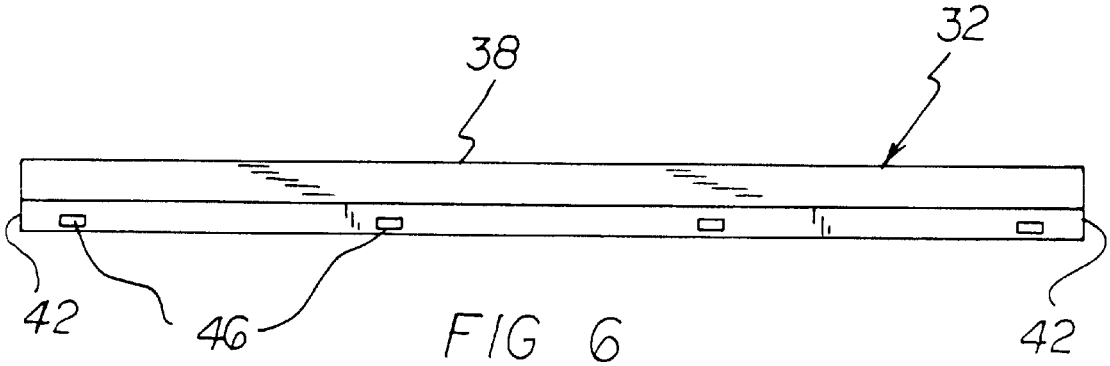
FIG 6
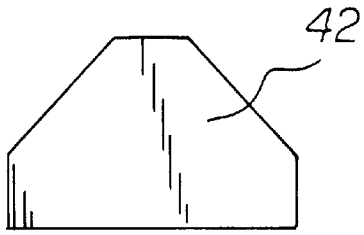
FIG 7

VEHICLE BARRIER/ADVERTISEMENT SYSTEM

BACKGROUND OF THE INVENTION

1. Field of the Invention

The present invention relates to a vehicle barrier/advertisement system and more particularly pertains to insuring proper vehicle positioning in a parking lot while providing advertisement.

2. Description of the Prior Art

The use of vehicle barriers and advertisements of known designs and configurations is known in the prior art. More specifically, vehicle barriers and advertisements of known designs and configurations previously devised and utilized for the purpose of advertising by conventional methods and apparatuses are known to consist basically of familiar, expected, and obvious structural configurations, notwithstanding the myriad of designs encompassed by the crowded prior art which has been developed for the fulfillment of countless objectives and requirements.

In this respect, the vehicle barrier/advertisement system according to the present invention substantially departs from the conventional concepts and designs of the prior art, and in doing so provides an apparatus primarily developed for the purpose of insuring proper vehicle positioning in a parking lot while providing advertisement.

Therefore, it can be appreciated that there exists a continuing need for a new and improved vehicle barrier/advertisement system which can be used for insuring proper vehicle positioning in a parking lot while providing advertisement. In this regard, the present invention substantially fulfills this need.

SUMMARY OF THE INVENTION

In view of the foregoing disadvantages inherent in the known types of vehicle barriers and advertisements of known designs and configurations now present in the prior art, the present invention provides an improved vehicle barrier/advertisement system. As such, the general purpose of the present invention, which will be described subsequently in greater detail, is to provide a new and improved vehicle barrier/advertisement system and method which has all the advantages of the prior art and none of the disadvantages.

To attain this, the present invention essentially comprises a vehicle barrier. The vehicle barrier has a vertical front face and a vertical rear face. The vehicle barrier also has a horizontal upper face. The vehicle barrier further has a pair of angled intermediate faces. The barrier also has a generally horizontal lower face. The horizontal lower face has a plurality of rectilinear recesses. The rectilinear recesses extend between the front and rear faces with a pair of end faces. The barrier is fabricated of concrete. The barrier has two vertical securement holes. The securement holes extend between the upper and lower faces offset from the groves. Cylindrical bars extend through the holes and into the ground for securement purposes. The barrier has a height of about 5 inches and a maximum width of about 7.25 inches and a length of about 60 inches. Provided next is a thin barrier cover. The thin barrier cover is positioned over the barrier. The thin barrier cover is fabricated of extruded polyvinyl chloride. The cover has a vertical front face and a vertical rear face. The cover further has a horizontal upper face and a pair of angled intermediate faces. The cover has a pair of end faces and a generally horizontal lower opening. The front and rear faces have a plurality of connecting slots there through. The connecting slots are aligned with the recesses. The cover is sized and shaped to be securely positioned over the barrier. All of the faces of the cover have a thickness of about 0.125 inches. A thin coating of acrylic is provided over the entirety of both the interior and exterior of the cover. A plurality of straps is provided next. The straps are fabricated of plastic with a width of about 0.56 inches. Each strap has a central extent positioned within a recess. Each strap has end extents. The end extents extend through an associated slot. Each end extent has a lower toothed surface and an associated toothed keeper adapted to receive end extents and is positioned in contact with an associated slot. In this manner the cover is held in contact with the barrier. Last provided is a thin advertisement sheet. The advertisement sheet is fabricated of a flexible plastic material. The sheet has an interior surface. The interior surface has an adhesive there on. A thin peel away strip is provided over the adhesive. The sheet has an exterior surface. The exterior surface has advertising indicia there on. The sheet is about 58 inches long and about 3 inches high. The advertisement sheet is adapted to have its peel away strip removed there from and then adhered to at least one angled intermediate face of the cover. In this manner the barrier with its cover will constitute a vehicle barrier for insuring proper vehicle positioning in a parking lot. In this same manner the indicia on the cover will provide advertisements to the occupants of the vehicle and to others.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is Important, therefore, that the claims be regarded as including such equivalent constructions insofar as they do not depart from the spirit and scope of the present invention.

It is therefore an object of the present invention to provide a new and improved vehicle barrier/advertisement system which has all of the advantages of the prior art vehicle barriers and advertisements of known designs and configurations and none of the disadvantages.

It is another object of the present invention to provide a new and improved vehicle barrier/advertisement system which may be easily and efficiently manufactured and marketed.

It is further object of the present invention to provide a new and improved vehicle barrier/advertisement system which is of durable and reliable constructions.

An even further object of the present invention is to provide a new and improved vehicle barrier/advertisement system which is susceptible of a low cost of manufacture with regard to both materials and labor, and which accordingly is then susceptible of low prices of sale to the consuming public, thereby making such vehicle barrier/advertisement system economically available to the buying public.

Even still another object of the present invention is to provide a vehicle barrier/advertisement system for insuring proper vehicle positioning in a parking lot while providing advertisement.

Lastly, it is an object of the present invention to provide a new and improved vehicle barrier/advertisement system comprises a thin barrier cover. The barrier cover has a vertical front face and a vertical rear face and a horizontal upper face and a pair of angled intermediate faces there between. The barrier cover also has a pair of end faces. The cover has a generally horizontal lower opening. The cover is sized and shaped to be securely positioned over a vehicle parking barrier. An advertisement sheet has an interior surface. The interior surface is positioned with respect to an angled intermediate face of the cover. The sheet also has an exterior surface with advertising indicia there on.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top plan view of the concrete barrier shown in FIG. 1.

FIG. 3 is a side elevational view of the barrier shown in FIG. 2.

FIG. 4 is an end elevational view of the barrier shown in FIGS. 2 and 3.

FIG. 5 is a top plan view of the barrier cover shown in FIG. 1.

FIG. 6 is a side elevational view of the barrier cover shown in FIG. 5.

FIG. 7 is an end elevational view of the barrier cover shown in FIGS. 5 and 6.

The same reference numerals refer to the same parts throughout the various Figures.

DESCRIPTION OF THE PREFERRED EMBODIMENT

Figure 1:
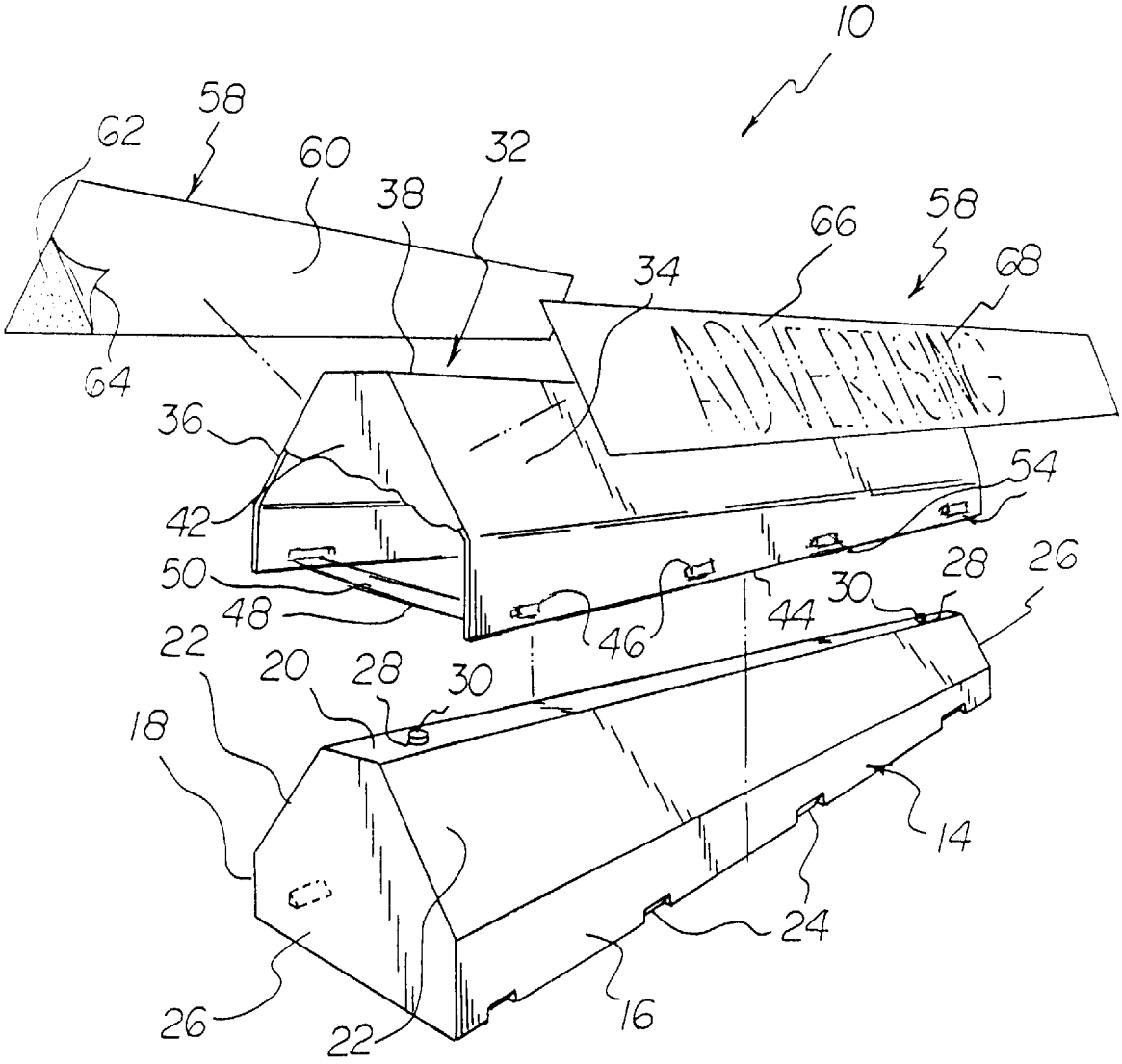
FIG. 1 is an exploded perspective illustration of the vehicle barrier/advertisement system constructed in accordance with the principles of the present invention.
Figure 8:
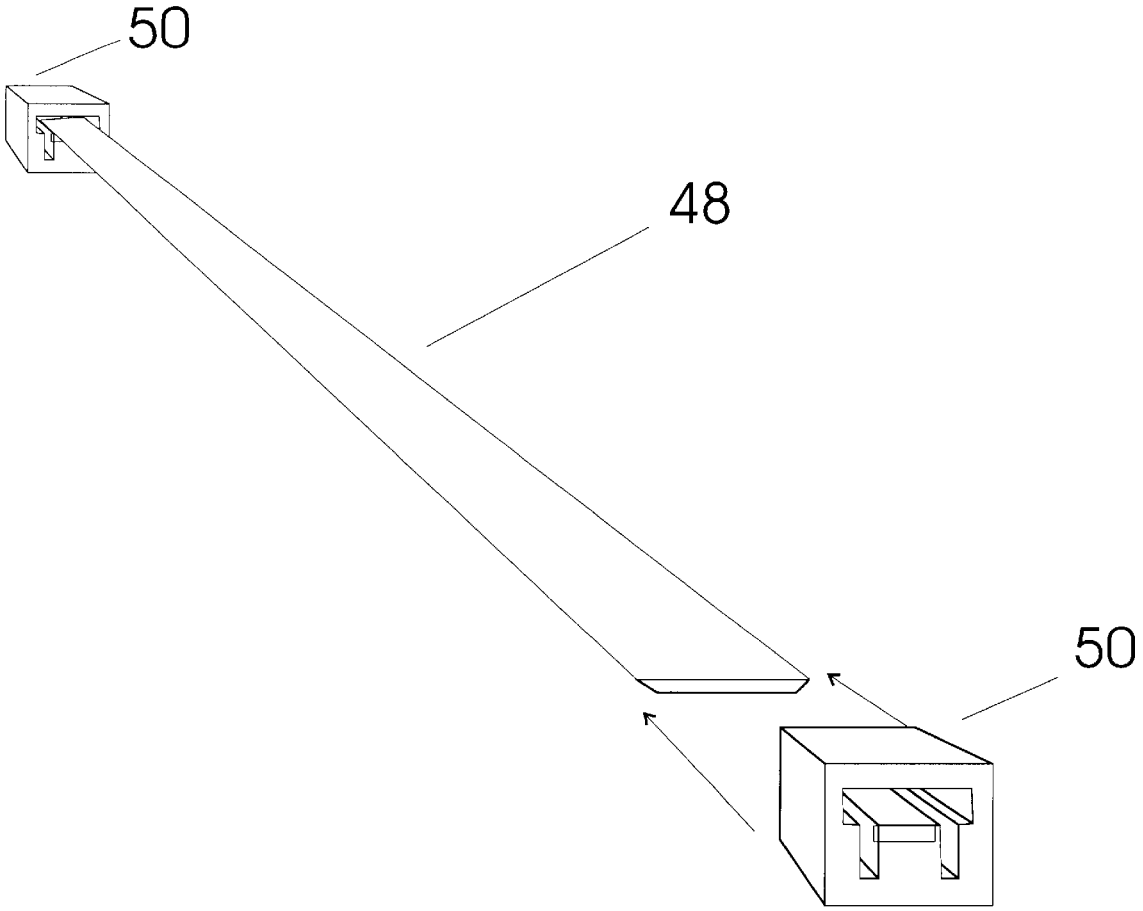
FIG. 8 is a cross sectional view of the ends of the strap.

With reference now to the drawings, and in particular to FIG. 1 thereof, the preferred embodiment of the new and improved vehicle barrier/advertisement system embodying the principles and concepts of the present invention and generally designated by the reference numeral 10 will be described.

The present invention, the vehicle barrier/advertisement system 10 is comprised of a plurality of components. Such components in their broadest context include a thin barrier cover and an advertisement sheet. Such components are individually configured and correlated with respect to each other so as to attain the desired objective.

First provided is a vehicle barrier 14. The vehicle barrier has a vertical front face 16 and a vertical rear face 18. The vehicle barrier also has a horizontal upper face 20. The vehicle barrier further has a pair of angled intermediate faces 22. The barrier also has a generally horizontal lower face 24. The horizontal lower face has a plurality of rectilinear recesses 24. The rectilinear recesses extend between the front and rear faces with a pair of end faces 26. The barrier is fabricated of concrete. The barrier has two vertical securement holes 28. The securement holes extend between the upper and lower faces offset from the groves. Cylindrical bars 30 extend through the holes and into the ground for securement purposes. The barrier has a height of about 5 inches and a maximum width of about 7.25 inches and a length of about 60 inches.

Provided next is a thin barrier cover 32. The thin barrier cover is positioned over the barrier. The thin barrier cover is fabricated of extruded polyvinyl chloride. The cover has a vertical front face 34 and a vertical rear face 36. The cover further has a horizontal upper face 38 and a pair of angled intermediate faces 40. The cover has a pair of end faces 42 and a generally horizontal lower opening 44. The front and rear faces have a plurality of connecting slots 46 there through. The connecting slots are aligned with the recesses. The cover is sized and shaped to be securely positioned over the barrier. All of the faces of the cover have a thickness of about 0.125 inches. A thin coating of acrylic is provided over the entirety of both the interior and exterior of the cover.

A plurality of straps 48 is provided next. The straps are fabricated of plastic with a width of about 0.56 inches. Each strap has a central extent 54 positioned within a recess. Each strap has end extents 52. The end extents extend through an associated slot. Each end extent has a lower toothed surface and an associated toothed keeper 50 adapted to receive the end extents and positioned in contact with an associated slot. In this manner the cover is held in contact with the barrier.

Last provided is a thin advertisement sheet 58. The advertisement sheet is fabricated of a flexible plastic material. The sheet has an interior surface 60. The interior surface has an adhesive 62 there on. A thin peel away strip 64 is provided over the adhesive. The sheet has an exterior surface 66. The exterior surface has advertising indicia 68 there on. The sheet is about 58 inches long and about 3 inches high. The advertisement sheet is adapted to have its peel away strip removed there from and then adhered to at least one angled intermediate face of the cover. In this manner the barrier with its cover will constitute a vehicle barrier for insuring proper vehicle positioning in a parking lot. In this same manner the indicia on the cover will provide advertisements to the occupants of the vehicle and to others.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present Invention.

Therefore, the foregoing is considered as illustrative only of the principles of the invention. Further, since numerous modifications and changes will readily occur to those skilled in the art, it is rot desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vehicle barrier/advertisement system for insuring proper vehicle positioning in a parking lot while providing advertisements comprising, in combination:

a vehicle barrier having a vertical front face and a vertical rear face and a horizontal upper face and a pair of angled intermediate faces there between, the barrier also having a generally horizontal lower face with a plurality of rectilinear recesses extending between the front and rear faces and with a pair of end faces, the barrier being fabricated of concrete with two vertical securement holes there through extending between the upper and lower faces offset from the ground with cylindrical bars extending through the holes and into the ground for securement purposes, the barrier having a height of about 5 inches and a maximum width of about 7.25 inches and a length of about 60 inches;

a thin barrier cover positioned over the barrier and fabricated of extruded polyvinyl chloride, the cover having a vertical front face and a vertical rear face and a horizontal upper face and a pair of angled intermediate faces there between, the cover also having a pair of end faces and a generally horizontal lower opening, the front and rear faces having a plurality of connecting slots there through aligned with the recesses, the cover being sized and shaped to be securely positioned over the barrier with all of the faces of the cover having a thickness of about 0.125 inches with a thin coating of acrylic over the entirety of both the interior and exterior of the cover;

a plurality of straps fabricated of plastic with a width of about 0.56 inches, each strap having a central extent positioned within a recess, each strap having end extents extending through an associated slot, each end extent having a lower toothed surface and an associated toothed keeper receiving the end extents and positioned in contact with an associated slot for holding the cover in contact with the barrier; and a thin advertisement sheet fabricated of a flexible plastic material, the sheet having an interior surface with an adhesive there on and a peel away strip over the adhesive, the sheet having an exterior surface with advertising indicia there on, the sheet being about 58 inches long and about 3 inches high, the advertisement sheet adapted to have its peel away strip removed there from and then adhered to at least one angled intermediate face of the cover whereby the barrier with its cover will constitute a vehicle barrier for insuring proper vehicle positioning in a parking lot while the indicia on the cover will provide advertisements to the occupants of the vehicle and to others.

2. A vehicle barrier/advertisement system comprising:

a vehicle barrier having a vertical front face and a vertical rear face and a horizontal upper face and a pair of angled intermediate faces there between, the barrier also having a generally horizontal lower face with a plurality of rectilinear recesses extending between the front and rear faces and with a pair of end faces, the barrier being fabricated of concrete with two vertical securement holes there through extending between the upper and lower faces offset from the ground with cylindrical bars extending through the holes and into the ground for securement purposes;

a thin barrier cover having a vertical front face and a vertical rear face and a horizontal upper face and a pair of angled intermediate faces there between and a pair of end faces, the cover also having a generally horizontal lower opening, the cover being sized and shaped to be securely positioned over a vehicle parking barrier;

a plurality of straps, each strap having a central extent positioned within a recess, each strap having end extents extending through an associated slot in the cover, each end extent having a lower toothed surface and an associated toothed keeper receiving the end extents and positioned in contact with an associated slot for holding the cover in contact with the barrier; and an advertisement sheet having an interior surface positioned with respect to an angled intermediate face of the cover, the sheet also having an exterior surface with advertising indicia there on.

* * * * *